US007070193B2

(12) United States Patent
Yamaguchi

(10) Patent No.: US 7,070,193 B2
(45) Date of Patent: Jul. 4, 2006

(54) SKATEBOARD TRUCK MOUNTING SYSTEM

(76) Inventor: Masashi Yamaguchi, 1-21-1 Shinzaike, Settsu-shi, Osaka 566-0055 (JP)

( * ) Notice: Subject to any disclaimer, the term of this patent is extended or adjusted under 35 U.S.C. 154(b) by 0 days.

(21) Appl. No.: 10/933,564

(22) Filed: Sep. 4, 2004

(65) Prior Publication Data

US 2006/0049594 A1 Mar. 9, 2006

(51) Int. Cl.
*B62M 1/00* (2006.01)

(52) U.S. Cl. ..... 280/87.042; 280/11.27; 280/11.26

(58) Field of Classification Search ..... 280/87.041, 280/87.042, 87.043, 11.27, 11.25, 11.33, 280/11.221, 11.16, 11.18, 11.223
See application file for complete search history.

(56) References Cited

U.S. PATENT DOCUMENTS 2,114,586 A * 4/1938 Bowen ..... 280/47.371
3,235,282 A * 2/1966 Bostick ..... 280/87.042
3,565,454 A * 2/1971 Stevenson et al. ..... 280/87.042
3,990,713 A * 11/1976 Hokanson ..... 280/87.042
4,029,330 A * 6/1977 Runyan, Jr. ..... 280/87.042
4,076,265 A 2/1978 Eash, II
4,458,907 A * 7/1984 Meredith ..... 280/87.042
5,522,620 A 6/1996 Pracas
6,523,837 B1 2/2003 Kirkland

FOREIGN PATENT DOCUMENTS

WO WO 80/01234 6/1980
WO WO 97/27916 8/1997
WO WO 2004/020059 3/2004

* cited by examiner

*Primary Examiner*—Hau Phan
(74) *Attorney, Agent, or Firm*—The Soni Law Firm

(57) ABSTRACT

The Skateboard Truck Mounting System is a mounting system for the attachment of a skateboard wheel truck to the deck of a skateboard. This system provides quick and easy adjustment to incrementally reposition a skateboard wheel truck assembly in a number of predetermined locations along the length of underside of the skateboard deck. This system may be utilized on new or existing decks to achieve personalized sizing and performance characteristics for a skateboard rider.

15 Claims, 8 Drawing Sheets

FIG. 9
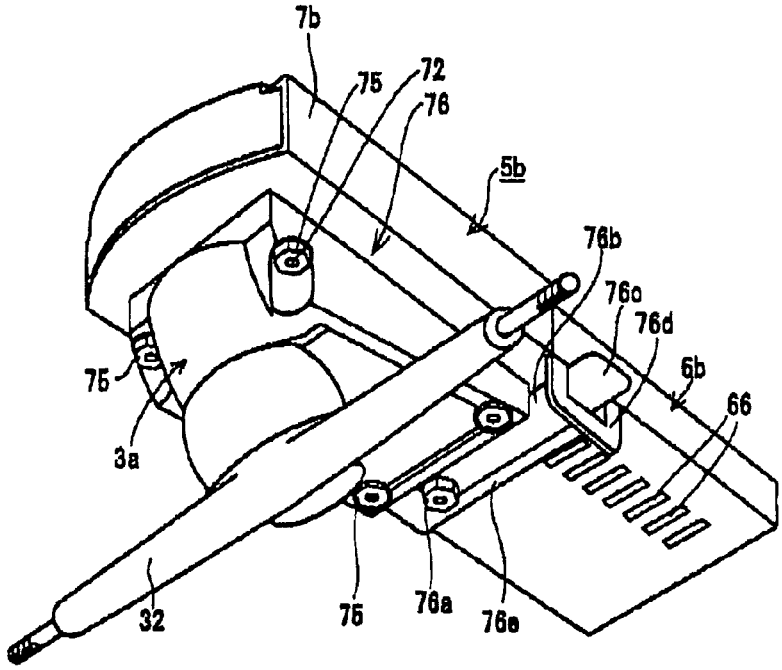
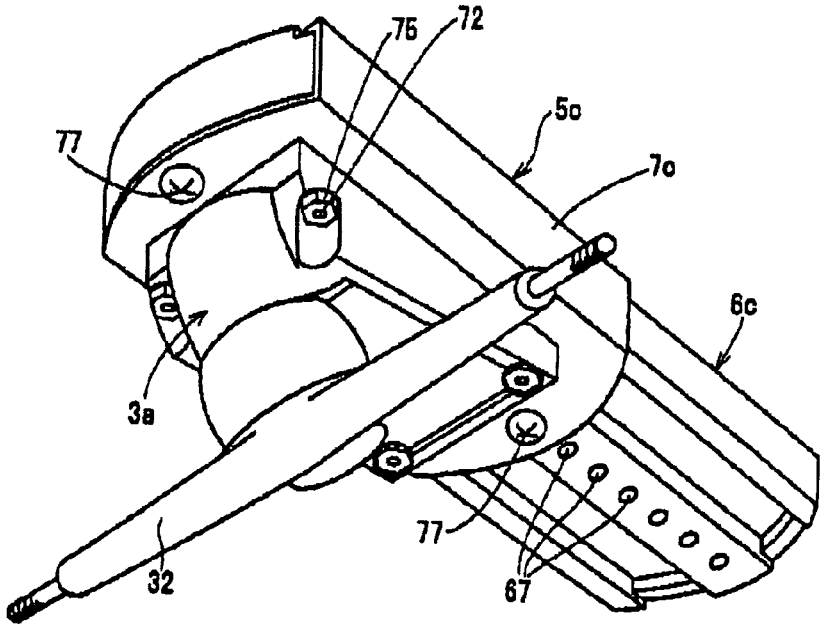
FIG. 10

SKATEBOARD TRUCK MOUNTING SYSTEM

The present invention is a mounting system for the attachment of a skateboard wheel truck to the deck of a skateboard. This system provides quick and easy adjustment to incrementally reposition a skateboard wheel truck assembly in a number of predetermined locations along the length of underside of the skateboard deck. This system may be utilized on new or existing decks to achieve personalized sizing and performance characteristics for a skateboard rider.

BACKGROUND OF THE INVENTION

The present invention relates to skateboarding, and more specifically, to a skateboard truck mounting system which permits a skateboard rider to adjust the linear position of at least one truck of a skateboard. The ability to quickly and easily adjust and thereby change the linear position of at least one truck allows the user to change the distance between the two wheel truck assemblies of a skateboard. Having independently adjustable trucks further permits a user to maintain a certain distance between the two but change the relative position of the pair of trucks forward or rearward on the board deck to which the trucks are mounted.

Skateboards are well known devices, as are the common fixed position skateboard wheel trucks by which the wheels are affixed to the board. Typically, the trucks are mounted to the board in a permanent manner so as to preclude any adjustment or repositioning with respect to the length of the board. This common design has inherent disadvantages, which include the inability to quickly and easily relocate at least one truck with respect to the board length. Based on the desired performance characteristics of the skateboard as well as physical size of the rider, it would be desirable to have the ability to vary the position of one or both trucks on the board since changing the relative positions correspondingly modifies the cornering, stiffness and other such performance characteristics of the skateboard.

While some conventional skateboards may be obtained with more than the standard four pre-drilled bolt holes for one or both ends of the skateboard deck for adjustment, these extra holes are unsightly to the product appearance, and also can affect on the structural integrity of the board. Moreover, the extra holes do not facilitate quick adjustment as the entire truck must still be removed and repositioned, a function typically accomplished with hand tools. Moreover, since this type of adjustment is strictly dependent on the hole positions, a conventional skateboard, even with additional predrilled mounting holes, presents the rider with only a limited range of locations for repositioning. Therefore, depending on the rider's height and weight and the level of the ability, even with extra holes, the conventional design may not be perfectly adjusted into the most suitable wheel-base position for each rider.

For the foregoing reasons, there is a need for a skateboard truck mounting system wherein at least one truck is quickly adjustable such that it may be positioned at varying points along the length of the board.

SUMMARY OF THE INVENTION

The present invention provides for a skateboard truck slide system whereby at least one skateboard wheel truck is adjustable such that it may be quickly and easily incrementally repositioned at a predetermined position longitudally displaced from its prior position, along the length of the underside of the skateboard.

The quick adjustment of the present invention renders the skateboard more versatile for riders of various physical sizes as well as varying levels of skateboard experience and capabilities. Moreover, the adjustment may be done in the field with little skill and no tools, thereby facilitating the use of the invention by innumerable riders.

The present invention comprises an adjustable sliding mounting system mounted to the bottom side of the skateboard deck at one or both ends (forward and aft). Typically in the manufacture and assembly of the skateboard, there are four bolt holes pre-drilled in the skateboard deck at each truck mounting position. The truck is then pressed against the back of the skateboard deck to match the pre-drilled 4 bolt holes for insertion of a flat headed bolt into each hole from the top side of the skateboard deck through both the deck and the truck's own pre-drilled bolt holes. Nuts typically fasten to each bolt to stabilize the truck.

The position where the rider stands (stance) on the skateboard deck may be varied depending on the style of the competition, such as slalom or downhill, the level of the rider's skill, or the height and weight of the rider. Accordingly, for best performance, the distance between the forward and aft wheels, referred to as the wheel-base, has to be adjusted to match each rider's preferred stance. If the relationship between the rider's stance and the wheel-base were incorrect, it would affect on the rider's safety and performance. The conventional skateboard, as mentioned above, uses predrilled bolt holes but its wheel-base cannot be changed. Typically, the rider of a conventional skateboard has to have a skateboard with custom-made truck mounting holes to suit his stance, which adds extra cost for the rider and which also may limit the preferred use of the skateboard to that individual rider. Additionally, the rider lacks the capability to freely adjust the stance of his own skateboard to suit changing his needs or the required performance characteristics for different types of competitions.

The present invention provides a skateboard with the truck mounting system that can be quickly and easily adjusted to the most suitable wheel-base position for any rider without the need to create extra boltholes on the skateboard deck The present invention thus permits a single skateboard be used for different competition events in the most suitable wheel base arrangement for each particular rider or event. Lastly, the present invention truck mount system can easily provide adjustment versatility to any conventional skateboard.

BRIEF DESCRIPTION OF THE DRAWINGS

FIG. 9 is a bottom right perspective view of an alternate embodiment of the adjustable truck of the skateboard truck system.

FIG. 10 is a bottom right perspective view of a second alternate embodiment of the adjustable truck of the skateboard truck system.

DETAILED DESCRIPTION OF THE PREFERRED EMBODIMENT

Figure 1:
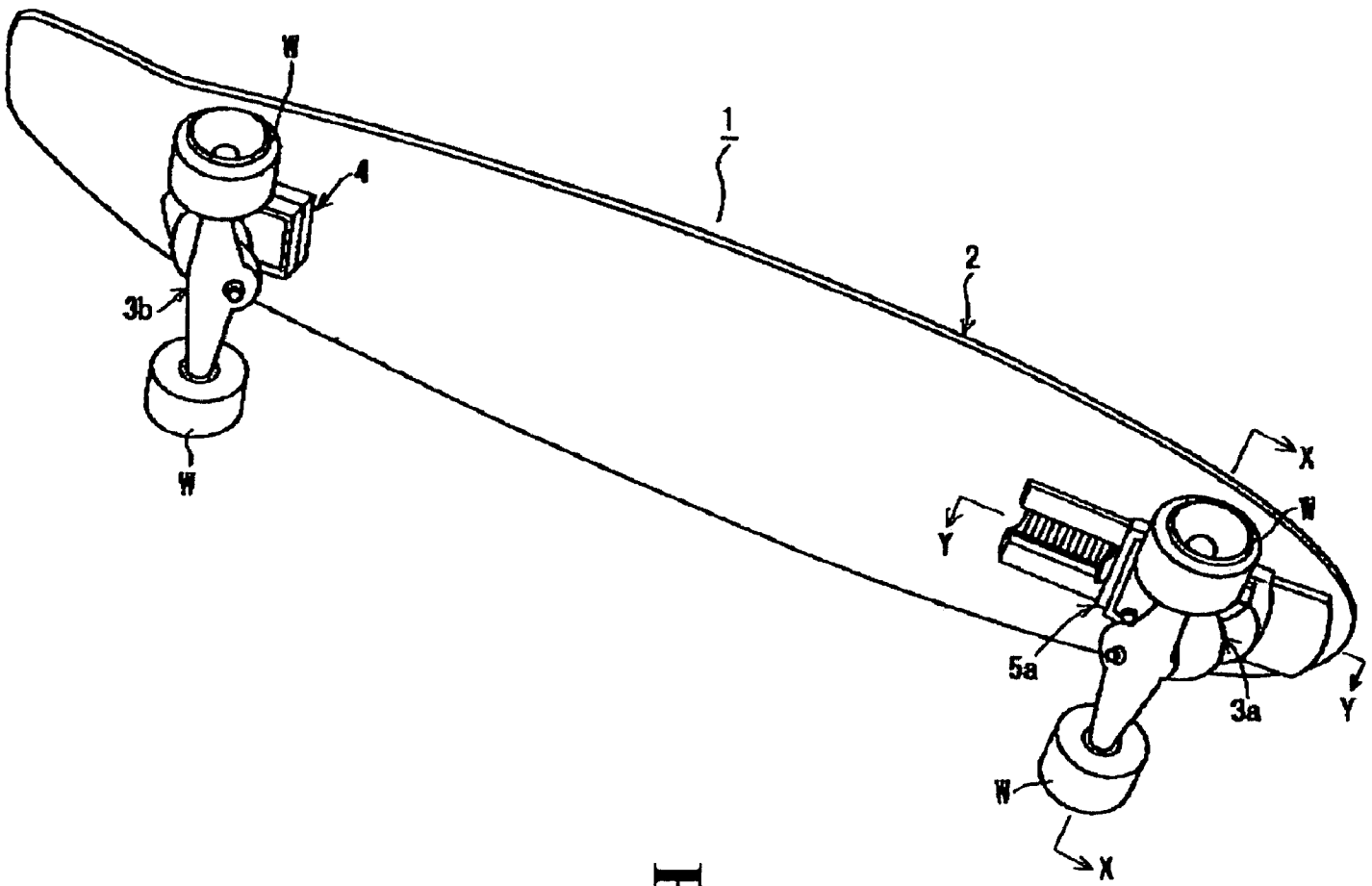
FIG. 1 is a bottom perspective view of the skateboard truck system.

FIG. 1 shows a conventional skateboard (1) with a skateboard truck (3*b*) mounted to the skateboard deck (2) in the rear position by conventional means of a riser (4) and a truck (3*a*) mounted to the deck in the forward position by means of the present invention skateboard truck system (5*a*). Although not shown on the figures, the skateboard deck (2) has a set of four conventional boltholes at both the forward and aft positions for attachment of the trucks. The conventional riser (4) is typically a rectangular shaped unit, which is not shown on the figure but has four boltholes on each corner to match with bolt holes (31) of the truck (3*b*). The conventional design aft truck (3*b*) is mounted on the skateboard deck with four flat headed bolts down through the top side of the deck, sandwiching a riser (4) between the deck and the truck (3*b*), and using four nuts on the extended end of the bolts at the bottom side of the truck (3*b*). As shown on FIG. 2, each truck also has 4 boltholes (31), one each at the four corners of the base plate (30), and axle (32) to mount the wheels, which is supported on the base plate unit (30) with the device which allows the axle (32) to freely change angle with respect to the deck (2).

Figure 2:
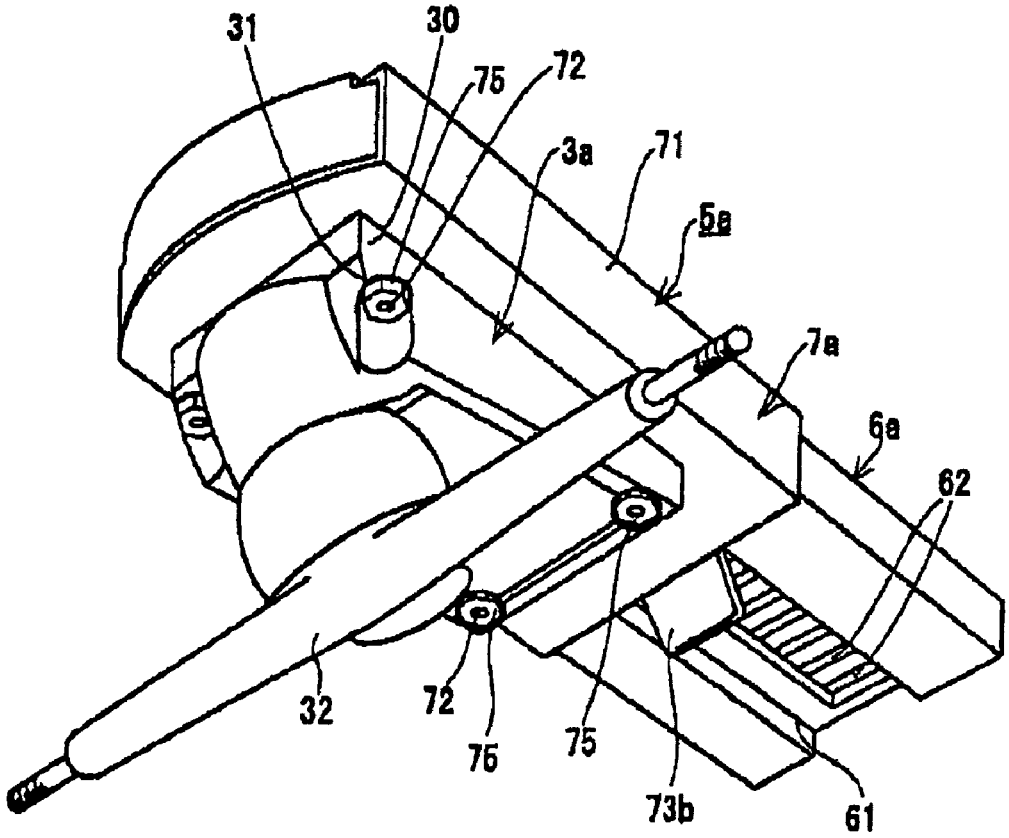
FIG. 2 is bottom perspective view of an adjustable truck of the skateboard truck system.
Figure 3:
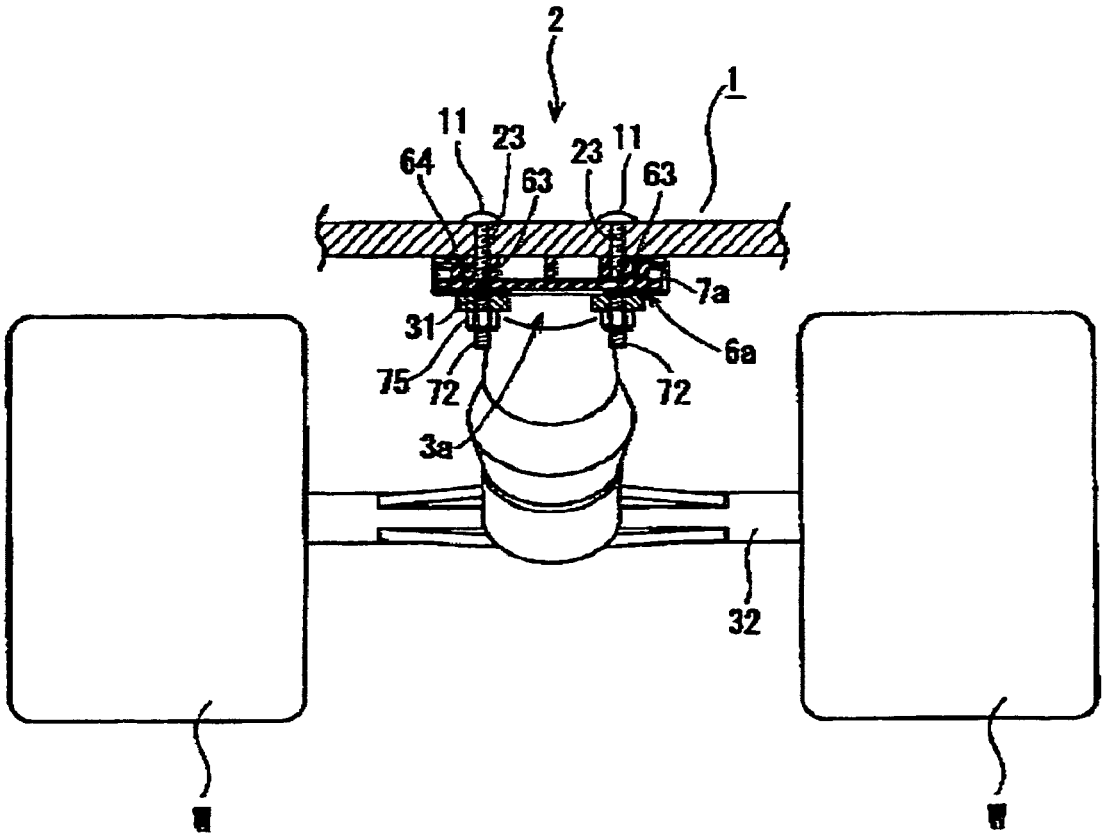
FIG. 3 is a rear view of an adjustable truck of the skateboard truck system.
Figure 4:
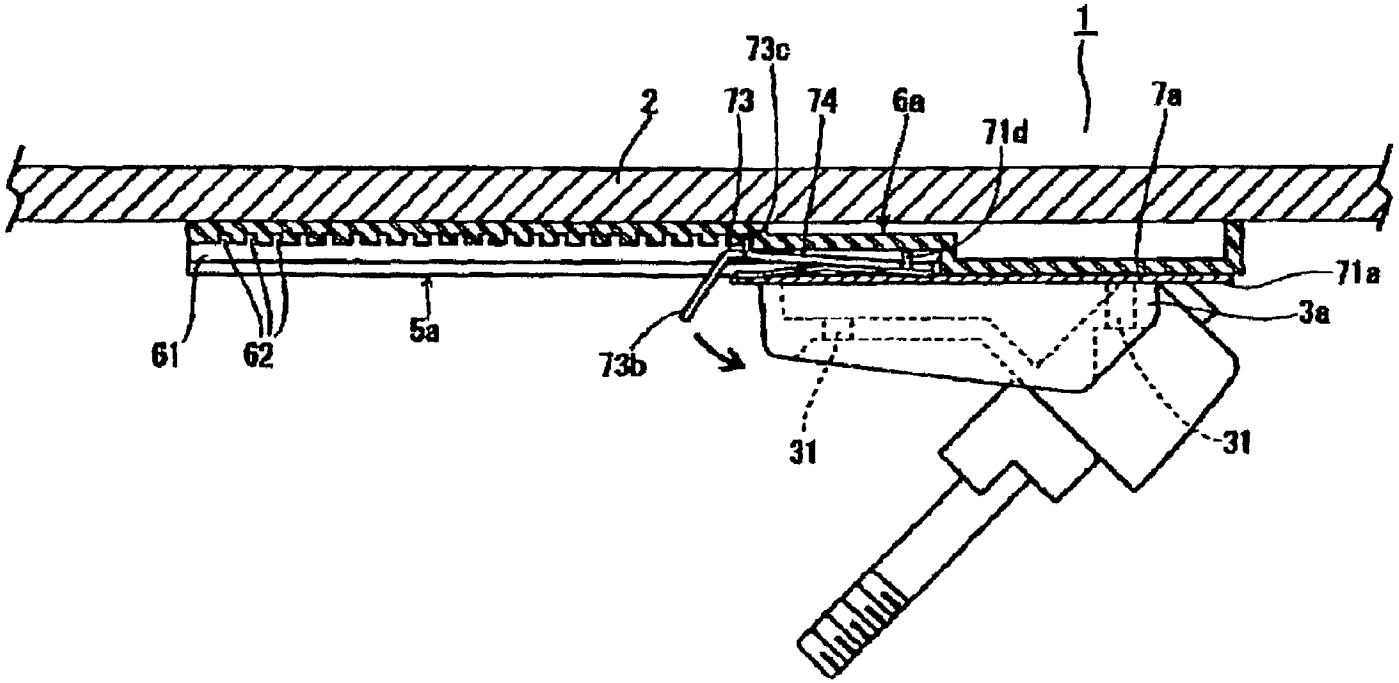
FIG. 4 is a left side view of the adjustable truck of the skateboard truck system.
Figure 5:
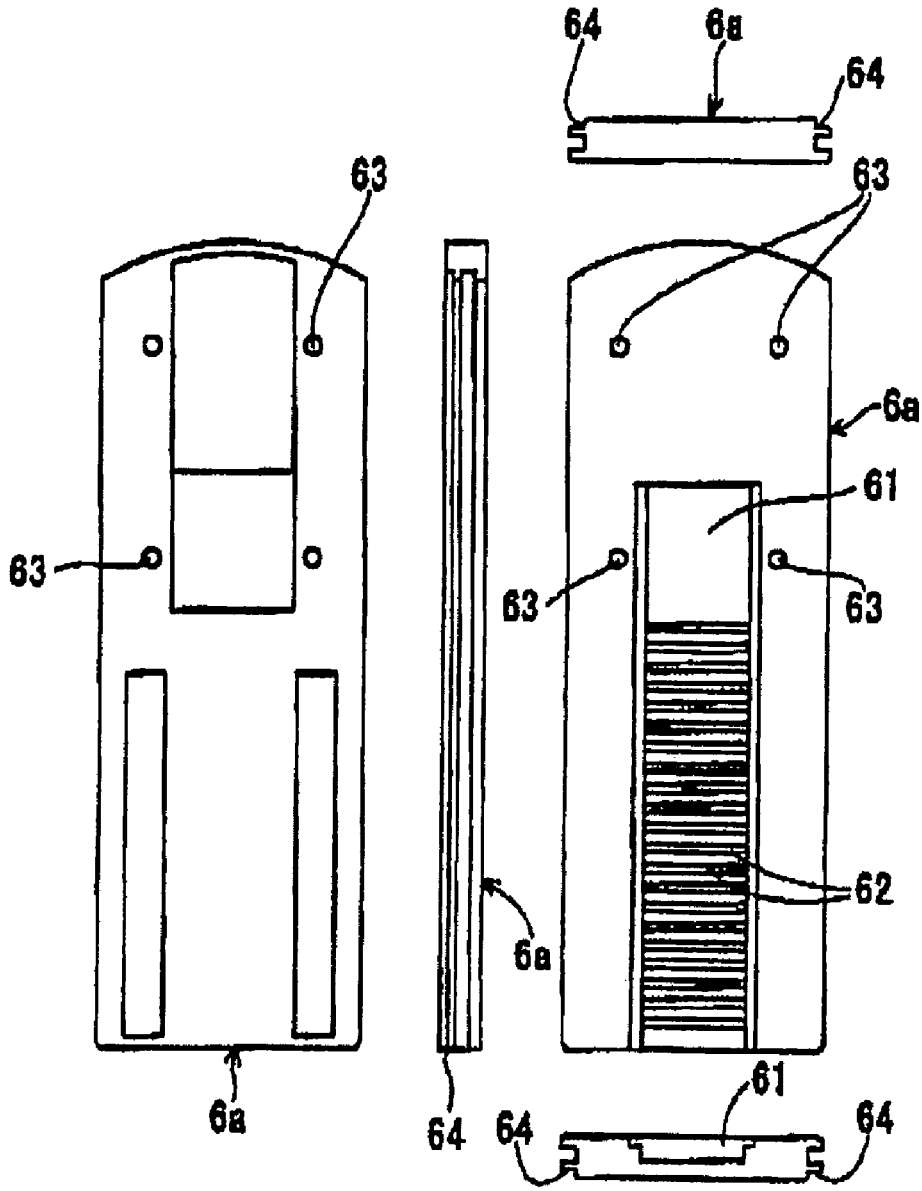
FIG. 5 depicts the mounting base component of the adjustable truck of the skateboard truck system.
Figure 6:
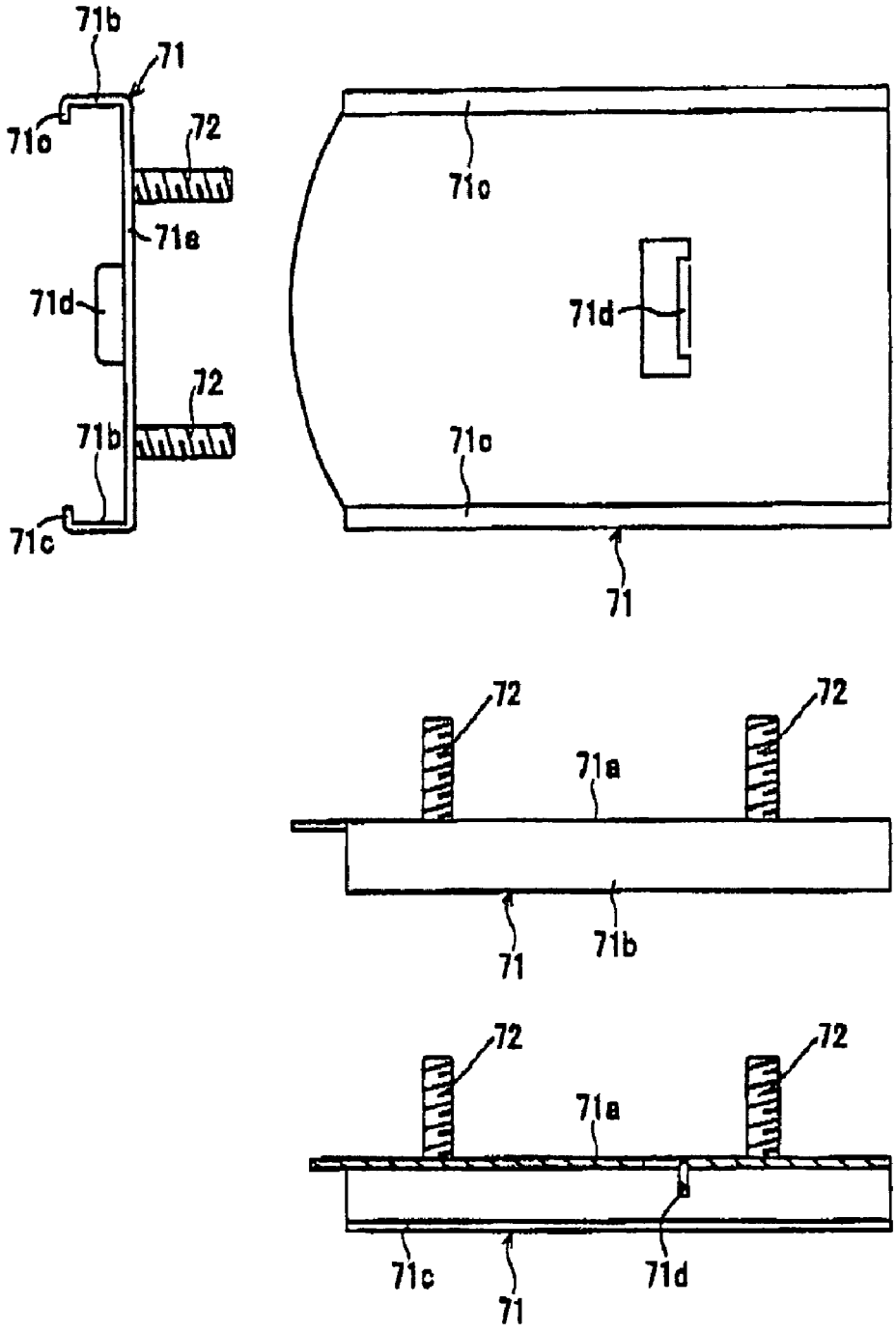
FIG. 6 depicts the sliding body component of the adjustable truck of the skateboard truck system.

The skateboard truck mounting system (5*a*), as shown on FIGS. 2 to 4, comprises a base unit (6*a*) which is mounted on the bottom side of the skateboard deck (2) at the pre determined and predrilled position and an adjustable sliding unit (7*a*) upon which a conventional skateboard truck (3*a*) will be mounted and the locking device (73) to secure the adjustable sliding unit (7*a*) in the selectable position. As shown on FIG. 5, one side of the base unit (6*a*) is grooved in the middle section from the one end toward the other end along approximately 75% of its length, and at the bottom of the groove (61), parallel and narrow even pitched grooves oriented perpendicular to the long axis of the middle section are included to secure the locking device to lock the adjustable sliding unit (7*a*) at a desired position. Although a smaller pitch of the locking groove (62) is preferable, it is commonly set at approximately 5 mm pitch for the application. The base unit (6*a*) also has four boltholes (63) to match with the conventional pre-drilled holes (23) on the typical skateboard deck. In addition, at the both side edges of the base unit (6*a*), an L shape tongue and groove (64) is cut to accept the adjustable sliding unit (7*a*). When the base unit (6*a*) is set on the deck (2), this L shape tongue and groove (64) makes the adjustable sliding unit both easily movable, and fixable with the adjustable sliding unit (7*a*) which has a locking clip (71*c*).

An adjustable sliding unit upon which a conventional skateboard truck can be mounted (7*a*), as shown on FIGS. 2–4 and 6, comprises a main body base (71) and four mounting bolts (72). The main body (71) is typically made of steel, and further comprises a cover (71*a*) which is the same width or slightly wider than the main body base (71), the sidings (71*b*) which are the end width of the cover (71*a*) and are angled upwards at 90 degrees, and the catch/tongue locking clip (71*c*) which can be fit into the groove (64) of the base unit (6*a*) to facilitate the sliding. The mounting bolts (72) which have same span of the boltholes (31) are welded vertically onto the top surface of the cover (71*a*).

Figure 7:
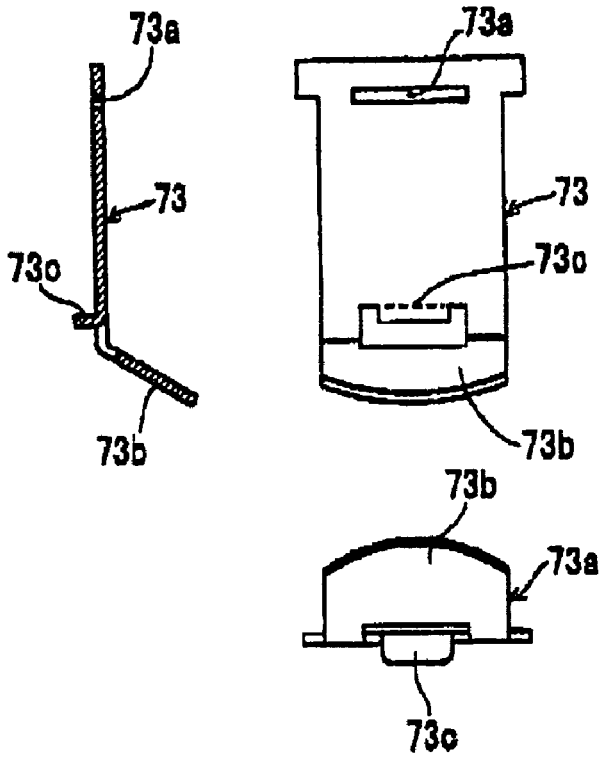
FIG. 7 depicts the locking device of the adjustable truck of the skateboard truck system.
Figure 8:
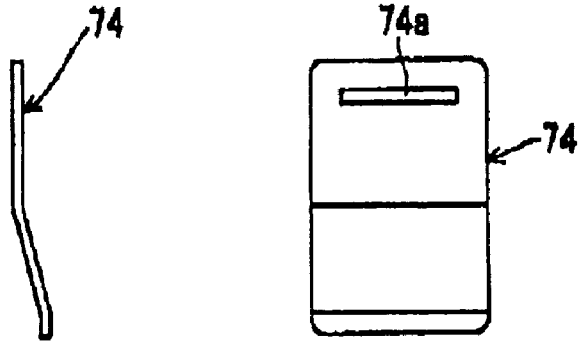
FIG. 8 depicts the spring plate of the locking device of the adjustable truck of the skateboard truck system.

The metal portion (73) and the spring plate (74), which are the parts of the locking device, are fixed at the inner side of the cover (71*a*). The locking device (73), as shown on FIGS. 4 and 7, comprises at one end the stopper groove (73*a*) to accept the stopper protuberance (71*d*), at the other end, a lever (73*b*) which is bent to a certain angle, and a nail like stopper tongue (73*c*) which is bent to the opposite side from a lever (73*b*) at the base of the lever. The spring plate (74), as shown on FIGS. 4 and 8, is formed with two angles as seen in FIG. 8, and has a stopper protuberance at one end.

To set up the skateboard mounting system (5*a*), the rider sets the convex side of the spring plate (74) to face the cover unit (71*a*), then attach the stopper protuberance (71*d*) of the spring plate (74) to the stopper groove (74*a*); connects the locking device (73) to the stopper protuberance (71*d*), facing lever (73*b*) side towards the spring plate (74); then while keeping this set up, inserts the nail like locking clip (71*c*) of the main body (71) to the groove (64) of the base unit (6*a*) from the open end of the groove (61), sliding the lever (73*b*) into the proper position while maintaining the spring plate's (74) pressure against the cover unit (71*a*); then while releasing the lever (73*b*) from the locking position, connects the stopper tongue (73*c*) into the locking groove (62). The total thickness of the base unit (6*a*) and the cover unit (71*a*) together is designed to be equal to the thickness of a conventional skateboard truck riser (4).

To Install the front truck (3*a*), onto the truck mounting system, the rider places the truck mounting system (5*a*) on to the bottom side of the skateboard deck (2); while matching the predrilled 4 bolt holes (63) on the base unit (6*a*) with the 4 bolt holes of the skateboard deck (2), screws down the bolts (11) into the screw holes (63) to fixate the base unit (6*a*) on to the skateboard deck (2). The rider then inserts the bolts (72) welded on to the main body unit (71) into the boltholes (31) of the truck (3*a*), and screws down the nut (75) to secure the main body unit (71) and the truck (3*a*).

On a skateboard (1) as described above, front truck (3*a*) is attached on to the skateboard deck (2) via the truck mounting system (5*a*). Therefore, if the lever (73*b*) was pulled toward to the truck (3*a*) and force is applied to either forward and aft of the skateboard deck (2) while releasing the stopper tongue (73*c*) from the locking groove (62), the truck (3*a*) would slide to the direction of the given force. Then, after the truck (3*a*) is slid to the desired selected position, when the lever (73*b*) is released, the lever (73*b*) is pressed to the base unit (6*a*) by the force of the spring plate (74), and the locking device (73) latches on to the locking groove (62) to fixate the truck (3*a*) at the selected position.

On a skateboard (1), the position of the front truck (3*a*) can be adjusted just with the ease of the touch of the lever. Without dismounting the truck (3*a*), the wheel base can be freely adjusted in small increments, and a single skateboard can offer the most comfortable, suitable and safe ride regardless of the experience, height and weight of the users.

In addition, above-mentioned skateboard truck mounting system (5*a*) can be used on any conventional skateboard, therefore if one who owns the conventional skateboard purchases the truck mounting system (5*a*), he or she too can convert the conventional skateboard into a skateboard incorporating this invention.

FIG. 9 shows a second embodiment of the truck mounting system. As shown on FIG. 9, this embodiment is similar to the above mentioned truck mounting system (5*a*) except that this truck mounting system (5*b*) has a main body (76), a plate like lever (76*b*) and one end of the plate like lever is fixed to the bottom side surface of the main body unit (76) using nut (76*a*). The other end of the plate like lever (76*c*) protrudes through an annular guide (76*d*) and to the side surface of main body (76). Although not shown on the Figure, the plate like lever (76*b*) has a stopper protrusion, which protrudes to the base (6*b*) through the cover unit (76*e*), designed to be locked in to the stopper groove (66).

FIG. 10 shows a third embodiment of the truck mounting system of this invention. As shown on FIG. 10, the components are the same as the above mentioned truck mounting system (5*a*) except that this truck mounting system (5*c*) has numerous incremental screw holes (67) on the base plate (6*c*) designed to accept screws (77) through two pre drilled holes, forward and aft part of the main body unit (7*c*) (not shown on FIG. 10) to slide and lock the main body unit (7*c*) into the selected position.

Although the above-mentioned embodiments describe mounting only the forward truck via the Truck Mounting System, it can be used for both forward and aft trucks on the same deck. Additionally, the base unit of system can be extended to the entire length of the skateboard deck to be shared with both forward and aft trucks, so the both trucks can be freely slide into any position throughout the length of the skateboard deck.

In yet another embodiment, the base unit of Truck Mounting System can be molded or otherwise integrally fabricated into the skateboard deck as one unit. The conventional trucks would then slidably engage the base unit by way of a sliding member.

What is claimed is:

1. A truck mounting system for mounting a wheel truck to a deck comprising a base unit, at least one adjustable sliding member and a locking device;

said base unit having a first end, a second end and a middle section, and further including a lengthwise channel commencing proximate the first end and extending toward the second end, with a set of indentations formed in the bottom of the said channel and aligned with the long axis of the channel, and the base unit further including lengthwise recesses;

said adjustable sliding member comprising a flat surface with two upwardly facing perpendicular sides and inward facing lip surfaces whereby each of the said lip surfaces is slidably engaged into the recesses of the base unit and said flat surface further including a slot and an upward extending stopper adjacent to the slot;

said locking device consisting of a flat surface with an upwardly extending tongue, the flat surface biased against the sliding member so as to apply pressure to the locking device to forcibly engage the tongue of the locking device into one of the indentations in the channel of the base unit.

2. The skateboard truck mounting system of claim 1 wherein the indentations formed in the channel along the long axis of the middle section comprise a set of parallel grooves.

3. The skateboard truck mounting system of claim 1 wherein the indentations formed in the channel along the long axis of the middle section comprise a set of generally circular detents.

4. The skateboard truck mounting system of claim 1 wherein the sliding member is made from stainless steel.

5. The skateboard truck mounting system of claim 1 wherein the base unit is made from one or more of the materials included within the group of fiberglass strengthened polyacetate, fiberglass strengthened polycarbonate, and fiberglass strengthened polyacrylamide (nylon).

6. The skateboard truck mounting system of claim 1 wherein the base unit is integrally formed into the under side of the deck of a skateboard.

7. The skateboard truck mounting system of claim 1 wherein the locking device further includes a lever by which the user may engage or disengage the locking device to alternatively lock or reposition the sliding member.

8. The skateboard truck mounting system of claim 7 wherein the lever to engage or disengage the locking device protrudes from the side of the mounting system to permit access therefrom.

9. A truck mounting system for mounting a wheel truck to a deck comprising a base unit, at least one adjustable sliding member and a locking device;

said base unit having a first end, a second end and a middle section, and further including a lengthwise channel commencing proximate the first end and extending toward the second end, with a set of indentations formed in the bottom of the said channel and aligned with the long axis of the channel, and the base unit further including lengthwise recesses;

said adjustable sliding member comprising a flat surface with two upwardly facing perpendicular sides and inward facing lip surfaces whereby each of the said lip surfaces is slidably engaged into the recesses of the base unit; and said flat surface further including a slot and an upward extending stopper adjacent to the slot;

said locking device consisting of a upper plate having a downwardly angled first end and a second end, with an upward facing tongue proximate to the first end and an opening proximate to second end whereby the opening fits over the sliding member stopper protuberance to secure the locking device to the sliding member, and further including a spring plate biased against the upper plate so as to apply pressure to the locking device to forcibly engage the tongue of the locking device into one of the grooves in the channel of the base unit; and said locking device further including a lever by which the user may engage or disengage the locking device to alternatively lock or reposition the sliding member.

10. The skateboard truck mounting system of claim 9 wherein the indentations formed in the channel along the long axis of the middle section comprise a set of parallel grooves.

11. The skateboard truck mounting system of claim 9 wherein the indentations formed in the channel along the long axis of the middle section comprise a set of generally circular detents.

12. The skateboard truck mounting system of claim 9 wherein the sliding member is made from stainless steel.

13. The skateboard truck mounting system of claim 9 wherein the base unit is made from one or more of the materials included within the group of fiberglass strengthened polyacetate, fiberglass strengthened polycarbonate, and fiberglass strengthened polyacrylamide (nylon).

14. The skateboard truck mounting system of claim 9 wherein the base unit is integrally formed into the under side of the deck of a skateboard.

15. The skateboard truck mounting system of claim 9 wherein the lever to engage or disengage the locking device protrudes from the side of the mounting system to permit access therefrom.

* * * * *